US008690461B2

(12) United States Patent
Richards

(10) Patent No.: US 8,690,461 B2
(45) Date of Patent: Apr. 8, 2014

(54) SYSTEM AND METHOD FOR CONTROLLING A MULTI-DRIVE PRINTING PRESS

(75) Inventor: John Sheridan Richards, Barrington, NH (US)

(73) Assignee: Goss International Americas, Inc., Durham, NH (US)

( * ) Notice: Subject to any disclaimer, the term of this patent is extended or adjusted under 35 U.S.C. 154(b) by 500 days.

(21) Appl. No.: 12/563,731

(22) Filed: Sep. 21, 2009

(65) Prior Publication Data

US 2011/0070010 A1 Mar. 24, 2011

(51) Int. Cl.
*B41J 11/44* (2006.01)

(52) U.S. Cl.
USPC ..... 400/76; 400/583; 400/611; 101/92; 101/91; 101/138; 101/156; 101/253; 712/31

(58) Field of Classification Search
USPC ..... 101/183, 91, 92, 138, 156, 168, 176, 101/196, 253, 288, DIG. 42; 721/31, 29; 400/76, 578, 583, 611, 618
See application file for complete search history.

(56) References Cited

U.S. PATENT DOCUMENTS

| | | | | |
|---|---|---|---|---|
| 5,049,798 | A | 9/1991 | Jackson | |
| 5,067,088 | A * | 11/1991 | Schneiderhan | 700/221 |
| 5,615,609 | A | 4/1997 | Hill et al. | |
| 5,894,802 | A | 4/1999 | Jackson | |
| 6,009,808 | A * | 1/2000 | Loffler | 101/211 |
| 6,701,836 | B2 | 3/2004 | Sommer | |
| 7,187,142 | B2 * | 3/2007 | Rehm | 318/400.04 |
| 7,448,321 | B2 | 11/2008 | Rügamer | |
| 7,712,415 | B2 | 5/2010 | Rügamer | |
| 2007/0116038 | A1 * | 5/2007 | Holt et al. | 370/465 |

* cited by examiner

*Primary Examiner* — Matthew G Marini
(74) *Attorney, Agent, or Firm* — Davidson, Davidson & Kappel, LLC

(57) ABSTRACT

A system and method are provided for controlling a printing press including a plurality of print units and, optionally, a folder. Each print unit has one or more cylinders, a motor for driving the cylinders; an encoder for providing a cylinder position signal, a controller coupled to the encoder, the motor, a bus which interconnects each of the controllers and an input port for designating the controller as either master or slave. Any one of the controllers is selectively set as a master controller and the remaining controllers are set as slave controllers. The master controller generates a control signal based on a signal from the input port and outputs the control signal to the motor via the output port and to the slave controllers via the bus. Each of the slave controllers outputs a signal on the respective output port based on the received control signal.

22 Claims, 3 Drawing Sheets

SYSTEM AND METHOD FOR CONTROLLING A MULTI-DRIVE PRINTING PRESS

The present invention relates generally to printing presses and more particularly to a device and method for controlling multiple printing towers.

BACKGROUND OF THE INVENTION

In a rotary printing press, a material web is guided through a plurality of printing units where the web may be printed on both sides and in many colors. It is then guided into a dryer, for example, a hot air dryer, in order to dry it. The web is then transported over cooling rollers of a cooling stand in order to cool down the web heated by the dryer. Thereafter, the web can be cut and folded into signatures in a folder and the signatures transported onward for further processing in, for example, a distribution system.

U.S. Pat. No. 5,049,798 discloses a control system for a printing press which is not reconfigurable and requires a master reference (FIG. 1) that is connected to a single preselected print unit. The preselected print unit acts as the master and provides control signals to each of the remaining print units and folders.

U.S. Pat. No. 5,615,609 discloses that a significant aspect of multi-color printing is the importance of achieving and maintaining precise print registration among each of the multiple printing cylinders as the printing operation is conducted. This precision is needed to obtain proper alignment of the multi-color ink patterns on the paper material and avoid overlap or smearing of the colored ink patterns. However, the system disclosed therein is not reconfigurable.

U.S. Pat. No. 5,894,802 also discloses a control system for a printing press which is not reconfigurable and requires an isolated position reference unit (FIGS. 3 and 4) that outputs a position reference signal to each of a plurality of print units based on a signal from a master reference source 32, with each print unit having a separate regulator (e.g., regulator 720) for controlling the speed of the drive motors (e.g., motor 3).

U.S. Pat. No. 6,701,836 discloses that for a drive system of a printing machine with drives for each printing stage and printing ink, respectively, it is necessary to keep the drive motors of the various drives synchronized in order to be able to realize good printed results. The drive system disclosed requires drive control units at each print unit and a separate master control unit which communicates with and provides control signals to each drive control unit.

U.S. Pat. Nos. 5,615,609, 5,894,802 and 6,701,836 are hereby incorporated by reference herein.

BRIEF SUMMARY OF THE INVENTION

The present invention provides a web printing press system comprising printing units having multiple shaft-less press drives.

Each printing unit is provided with a control unit. One printing unit is selected as the master to provide for a minimum of print variation and increased print stability. The control unit associated with this printing unit is designated as the master control unit. The control units at all of the other print units and distribution systems, e.g., a folder, are designated as slave control units and operate based on signals received from the master motion control unit.

Advantageously, each control unit is user-configurable as either a master or slave control unit to allow any printing unit to be designated as the master, with the remaining control units designated as slaves to the master.

In particular, the present invention is directed to an apparatus for controlling a printing operation of a printing press. The apparatus having features of the present invention comprises a plurality of motors, a plurality of sensors, a plurality of controllers and a bus connected to each of the controllers. Each sensor is associated with a respective motor and provides a signal representing a parameter to be controlled. Likewise, each controller is associated with a respective motor and has an input port coupled to the associated sensor, an output port coupled to the associated motor, a bus interface and an input port. The controller input port is used to designate the controller as either a master device or a slave device. In operation, any one of the controllers is selectively set as the master controller and the remaining controllers are set as slave controllers. The master controller generates a control signal based on the input from the associated sensor and outputs the control signal to the associated motor via the output port and to the slave controllers via the bus. Finally, each of the slave controllers outputs a signal on the respective output port to the respective associated motors based on the received control signal.

In another embodiment, the present invention is directed to an apparatus for controlling a printing operation of a printing press comprising a plurality of units. Each unit comprises at least one cylinder, a motor for driving the at least one cylinder during the printing operation, an encoder for providing a position signal for a selected one of the at least one cylinders, a controller having an input port coupled to the encoder, an output port coupled to the motor, a bus interface and an input port for designating the controller as one of a master device and a slave device. A bus interconnects each of the controllers via the respective bus interfaces of the controllers. In operation, any one of the controllers is selectively set as the master controller and the remaining controllers are set as slave controllers. The master controller generates a control signal based on the input from the encoder and outputs the control signal to the motor via the output port and to the slave controllers via the bus. Each of the slave controllers outputs a signal on the respective output port based on the received control signal. The units may comprise print units or ancillary equipment such as a folder.

Finally, the present invention is directed to a method for controlling the printing operation of a printing press. The printing press comprises a plurality of motors, a plurality of sensors, each sensor associated with a respective motor, a plurality of controllers, each controller associated with a respective motor, and a bus interconnecting each of the controllers. The method comprises selectively setting any one of the controllers as a master controller and the remaining controllers as slave controllers. The master controller generates a control signal based on an input from the sensor and outputs the generated control signal to the associated motor and to the slave controllers. Each slave controller receives the generated control signal from the master controller, generates a signal based on the control signal received from the master controller, and outputs the generated signal to the associated motor.

BRIEF DESCRIPTION OF THE DRAWINGS

Further features and advantages of the present invention will become apparent from the following detailed description taken in conjunction with the accompanying drawings, in which.

DETAILED DESCRIPTION

Figures 1, 1A, 1B:
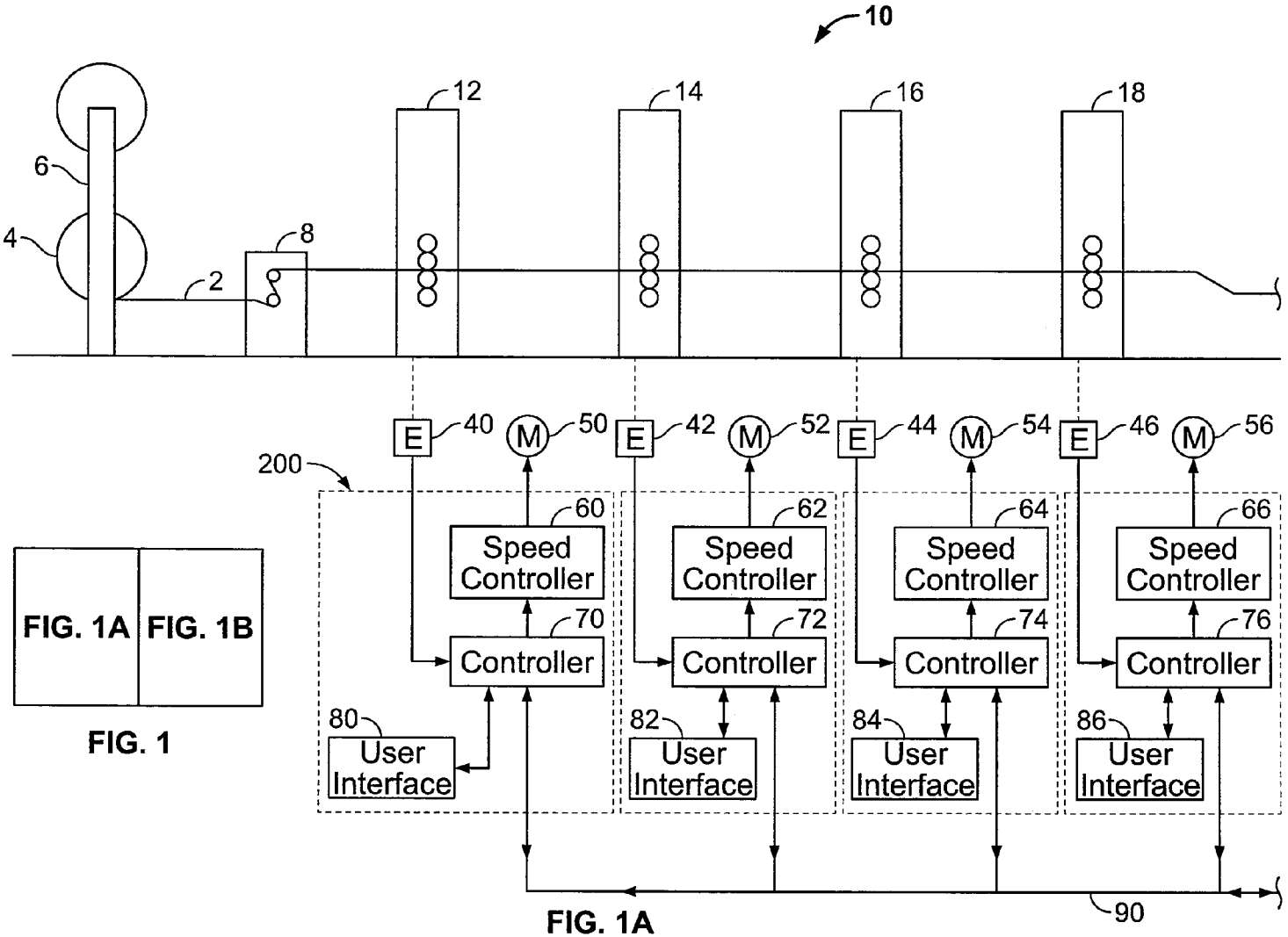
FIGS. 1, 1*a* and 1*b* are a block diagram of a multi-unit printing press according to the present invention.
Figure 1B:
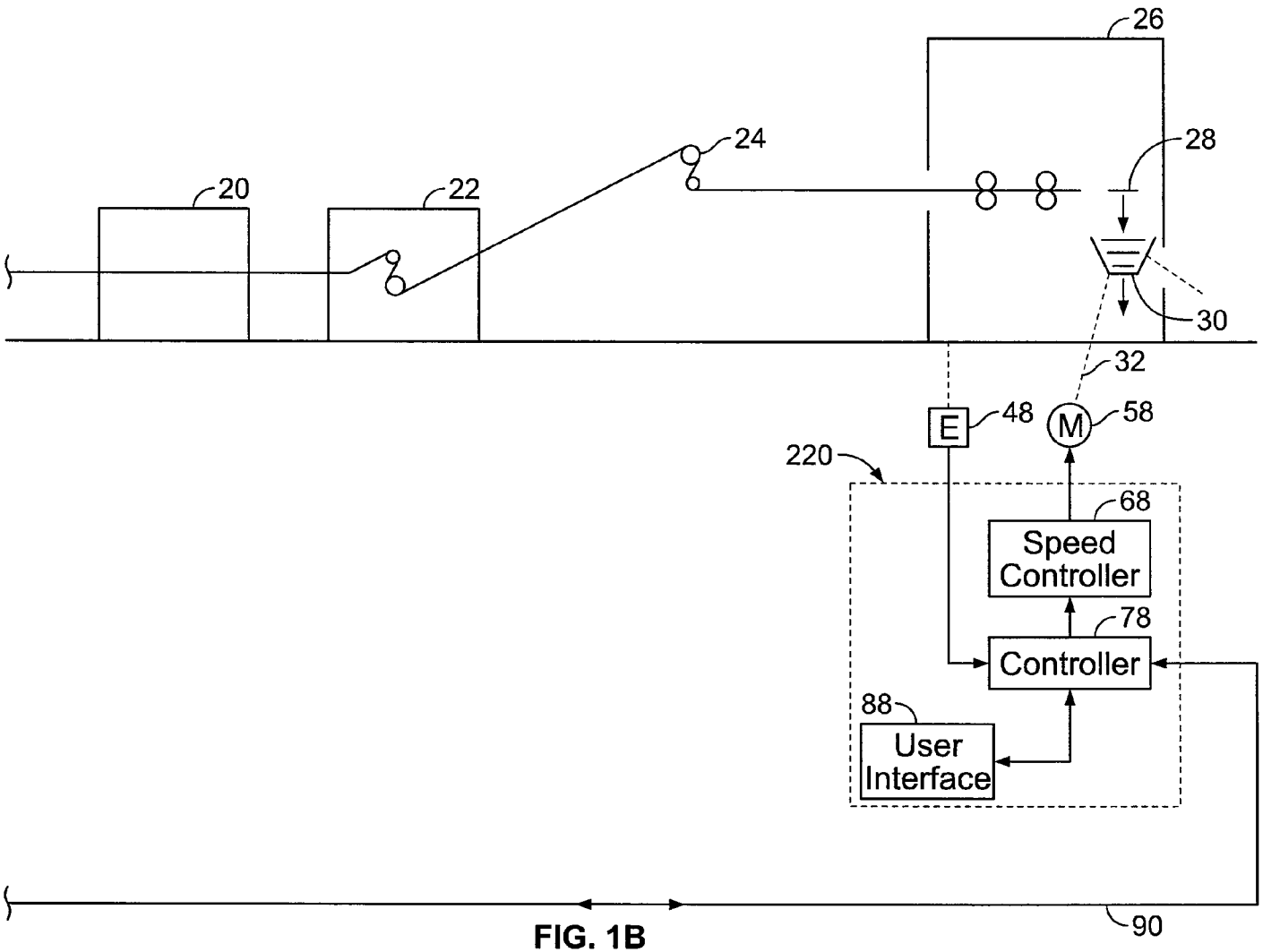

FIG. 1 shows a web rotary printing press 10 which includes a web 2 moving sequentially through multi-color printing units 12, 14, 16, 18, a hot air dryer 20 and a cooling stand 22. The web then moves into a folder 26 where the web may be cut into signatures 28 and conveyed elsewhere for further processing 32.

The printing units 12, 14, 16, 18 and the folder 26 are driven by respective drive motors 50, 52, 54, 56 and 58 which are controlled by respective speed controllers 60, 62, 64, 66 and 68. Speed controllers 60, 62, 64, 66 and 68 provide appropriate speed control signals to the associated motors to allow each motor to be operated at a selected speed within the operating range of the motor.

Each speed controller 60, 62, 64, 66 and 68 receives control signals from a respective control unit 70, 72, 74, 76 and 78. Each control unit 70, 72, 74, 76 and 78 receives a feedback signal from an associated encoder 40, 42, 44, 46 and 48 representing, for example, the position of a cylinder within the respective printing unit driven by the respective motor. As one of skill in the art will readily recognize, other types of sensors may be used to generate a feedback signal. This feedback signal from the encoders 40, 42, 44, 46 and 48 can be used to calculate the speed of rotation of the cylinder. As one of skill in the art would readily recognize, respective speed controllers 60, 62, 64, 66 and 68 and control units 70, 72, 74, 76 and 78 could be combined into a single assembly or circuit. The type of control signals required for the drive motor depends on the type of drive motor chosen, which could influence whether the respective speed controllers and control units could be combined into a single assembly.

Each control unit 70, 72, 74, 76 and 78 is coupled to a respective user interface 80, 82, 84, 86 and 88 that allows a user to configure the associated control unit. The user interface is conventional in design, and for the simplest case could simply be a switch. In the alternative, a keypad and display could be provided in situations where other parameters, not related to the present invention, also need to be set for each control unit. The user sets, via the user interface, one of the control units 70, 72, 74, 76 and 78 (e.g., control unit 70) to be the master and the remaining control units (e.g., control units 72, 74, 76 and 78) are then set to be the slaves. Each of the control units is interconnected via a communications bus 90, of conventional design.

In operation, the control unit selected to be the master, e.g., control unit 70, sets a control signal for its speed controller 60 based on the feedback signal received from encoder 40. In addition, the control unit selected to be the master sends a signal via bus 90 to each of the slave control units (e.g., control units 72, 74, 76 and 78) which is used by each respective slave control unit to generate a control signal for the respective speed controllers (e.g., speed controllers 62, 64, 66 and 68). In this manner, only the master control unit generates a control signal based on the feedback from the encoder at the print unit, and the slave control units generate control signals based on the control signal received from the master control unit via bus 90 effectively disregarding the feedback signal from the encoders associated with the slave control units.

The print unit designated as the master is usually the unit with the least print variation or that can best meet the current print job requirements, e.g., the front page print tower 100. A folder 26 or other lead processing equipment may alternatively be set as the master via the associated control unit, i.e., control unit 78 for the folder 26, at the election of the user.

Figure 2:
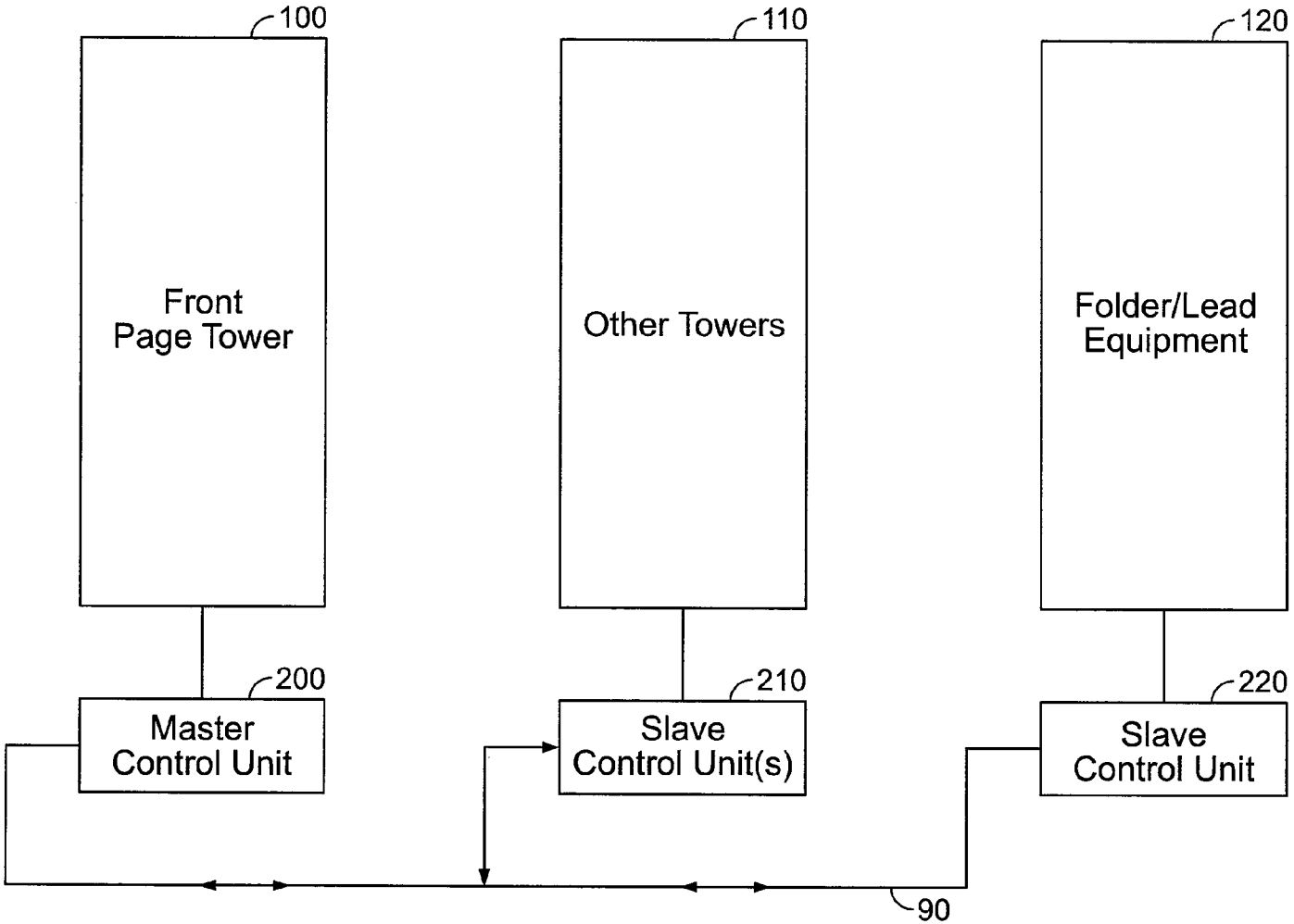
FIG. 2 is a block diagram of a particular control system according to the present invention.

FIG. 2 is a block diagram of one particular configuration of a web printing press system, in which control unit 200 for one tower, i.e., the front page print tower 100, is configured via a user interface, not shown, to be the master control unit, and the control units 210 for the other print towers 110 and the control units 220 for the folder and/or other lead equipment 120 are configured via the respective user interfaces (also not shown) to be slave control units. Each of the control units 200, 210 and 220 are interconnected via conventional communications bus 90. In operation, master control unit 200 generates control signals based on feedback signals from an encoder (not shown) and transmits those control signals to a motor speed controller (also not shown). In addition, master control unit 200 also transmits information to slave control units 210 and 220 used by the slave control units 210 and 220 to generate control signals for the respective motor speed controller associated with each of the slave control units 210 and 220, independently of any feedback signals from the associated print unit or folder or other lead equipment.

The foregoing merely illustrates the principles of the invention. It will thus be appreciated that those skilled in the art will be able to devise numerous other arrangements which embody the principles of the invention and are thus within its spirit and scope.

What is claimed is:

1. An apparatus for controlling a printing operation of a printing press comprising:

a plurality of motors;

a plurality of sensors, each sensor associated with a respective motor, each of the sensors providing a signal representing a parameter to be controlled;

a plurality of controllers, each controller associated with a respective motor, each of the controllers having a first input port coupled to the associated sensor, an output port coupled to the associated motor, a bus interface and a second input port for selectively setting the controller as one of a master device and a slave device; and a bus connected to each of the controllers via respective bus interfaces of the controllers;

each controller including a user interface, the user interface connected to the second input port, the user interface of each controller configured to selectively set a corresponding one of the plurality of controllers as one of a master device and a slave device;

any one of the controllers being selectively set as a master controller and the remaining controllers are set as slave controllers, the master controller generates a control signal based on a signal from the first input port and outputs the control signal to the associated motor via the output port and to the slave controllers via the bus; and each of the slave controllers outputs a signal on the respective output port to the respective associated motors based on the received control signal.

2. The apparatus of claim 1, further comprising a plurality of cylinders, at least one of the plurality of cylinders being associated with a respective motor.

3. The apparatus of claim 2, wherein the sensors are encoders which provide a position signal for a selected one of the at least one of the plurality of cylinders.

4. The apparatus of claim 1, wherein each associated motor, sensor and controller are mounted in a separate unit.

5. The apparatus of claim 4, wherein each unit is a print unit.

6. The apparatus of claim 4, wherein the units comprise at least one print unit and at least one folder.

7. The apparatus of claim 4, wherein the units comprise a plurality of print units and at least one folder.

8. The apparatus of claim 4, wherein the units comprise a plurality of print units including a front page print unit.

9. The apparatus of claim 8, wherein the controller mounted in the front page print unit is set as the master controller.

10. The apparatus of claim 1, further comprising a plurality of speed controllers, each speed controller associated with a respective motor and controller, and coupled between the controller and the motor for translating the control signal from the controller from a first format to a second format.

11. The apparatus of claim 1, wherein the user interface comprises a switch.

12. The apparatus of claim 1, wherein the user interface comprises a keypad and display.

13. A method for controlling a printing operation of a printing press, the printing press comprising a plurality of motors, a plurality of sensors, each sensor associated with a respective motor, a plurality of controllers, each controller associated with a respective motor, and a bus interconnecting each of the controllers, comprising the steps of:

(a) selectively setting one of the controllers as a master controller for a first print job;

(b) setting the remaining controllers as slave controllers;

(c) generating, in the master controller, a control signal based on an input from the sensor;

(d) outputting, in the master controller, the generated control signal to the associated motor and to the slave controllers;

(e) receiving, in each of the slave controllers, the generated control signal from the master controller;

(f) generating, in each of the slave controllers, a signal based on the control signal received from the master controller;

(g) outputting, in each of the slave controllers, the respective generated signals to the respective associated motors; and (h) repeating steps (a) through (g) for a second print job, with a different one of the controllers as the master controller.

14. An apparatus for controlling a printing operation of a printing press comprising:

a plurality of units, each of the units comprising:

at least one cylinder, a motor for driving the at least one cylinder during the printing operation;

an encoder for providing a position signal for a selected one of the at least one cylinders, and a controller having a first input port coupled to the encoder, an output port coupled to the motor, a bus interface and a second input port for selectively setting the controller as one of a master device and a slave device;

a user interface, the user interface connected to the second input port, the user interface configured to selectively set the controller as one of the master device and the slave device; and a bus connected to each of the controllers via respective bus interfaces of the controllers;

any one of the controllers being selectively set as a master controller and the remaining controllers are set as slave controllers, the master controller generates a control signal based on a signal from the first input port and outputs the control signal to the motor via the output port and to the slave controllers via the bus; and each of the slave controllers outputs a signal on the respective output port based on the received control signal.

15. The apparatus of claim 14, wherein the plurality of units comprises a plurality of print units.

16. The apparatus of claim 14, wherein the plurality of units comprises at least one print unit and at least one folder.

17. The apparatus of claim 14, wherein the plurality of units comprises a plurality of print units and at least one folder.

18. The apparatus of claim 15, wherein the units comprise a plurality of print units including a front page print unit.

19. The apparatus of claim 18, wherein the controller mounted in the front page print unit is set as the master controller.

20. The apparatus of claim 14, further comprising a plurality of speed controllers, each speed controller associated with a respective motor and controller, and coupled between the controller and the motor for translating the control signal from the controller from a first format to a second format.

21. The apparatus of claim 14, wherein the user interface comprises a switch.

22. The apparatus of claim 14, wherein the user interface comprises a keypad and display.

* * * * *